US006874237B2

(12) United States Patent
Robitaille

(10) Patent No.: US 6,874,237 B2
(45) Date of Patent: Apr. 5, 2005

(54) HANDLE CUTTER ASSEMBLY

(75) Inventor: Lionel L. Robitaille, 5726 Kilmore Cres E., Surrey, British Columbia (CA)

(73) Assignee: Lionel L. Robitaille, Surrey (CA)

( * ) Notice: Subject to any disclaimer, the term of this patent is extended or adjusted under 35 U.S.C. 154(b) by 68 days.

(21) Appl. No.: 10/440,328

(22) Filed: May 19, 2003

(65) Prior Publication Data

US 2004/0231168 A1 Nov. 25, 2004

(51) Int. Cl.[7] ..... B26B 3/00
(52) U.S. Cl. ..... 30/316; 30/315
(58) Field of Search ..... 30/2, 143, 146, 30/315, 316, 358, 359, 360

(56) References Cited

U.S. PATENT DOCUMENTS

| | | | | | |
|---|---|---|---|---|---|
| 2,152,063 | A | | 3/1939 | Klumb | |
| 2,830,369 | A | * | 4/1958 | Long | 30/310 |
| 3,026,299 | A | * | 10/1962 | Koepfinger | 172/18 |
| 3,171,200 | A | * | 3/1965 | Poppenga | 30/130 |
| 3,765,282 | A | * | 10/1973 | Crain, Jr. | 83/13 |
| 4,010,543 | A | | 3/1977 | Nusbaum | |
| 4,494,426 | A | | 1/1985 | Hartzell | |
| 4,607,553 | A | | 8/1986 | Hartzell | |
| 4,689,885 | A | | 9/1987 | Albanese | |
| 5,020,220 | A | | 6/1991 | Miyake et al. | |
| 5,242,024 | A | * | 9/1993 | Van Houten | 172/19 |
| 5,430,940 | A | | 7/1995 | Lym | |
| 5,806,190 | A | | 9/1998 | Robitaille | |
| 5,899,372 | A | * | 5/1999 | Rodriguez | 225/1 |
| 2003/0200664 | A1 | * | 10/2003 | Thompson et al. | 30/315 |

* cited by examiner

*Primary Examiner*—Hwei-Siu Payer
(74) *Attorney, Agent, or Firm*—Marks & Clerk

(57) ABSTRACT

A handle cutter assembly for making C-shaped handle cuts in cardboard boxed and the like. The cutter assembly has a body having an outer shell defining a blade cavity therein. The body has an upper end and a lower end. A lower aperture is positioned in the lower end. The body also has a blade slider mounted thereto and a grip portion is mounted to its upper end. A cutting blade is mounted within the blade cavity. The cutting blade is slidable by the blade slider between a retracted position substantially within the blade cavity and a cutting position. In the cutting position, the cutting blade extends below the lower end through the lower aperture. The cutting blade has a cutting edge extending away from the body which has a C-shaped cutting profile.

19 Claims, 7 Drawing Sheets

HANDLE CUTTER ASSEMBLY

FIELD OF THE INVENTION

The present invention relates to the art of packaging tools used in the packaging and shipping of items in cardboard boxes and the like and more particularly pertains to a new handle cutter assembly for the purpose of cutting handle holes into a cardboard box.

BACKGROUND

Cardboard boxes are used in the shipping and storage of a wide variety of products. Cardboard boxes are convenient, relatively durable, reusable and recyclable. There are many cardboard boxes in use for household storage which were originally used to ship other goods.

Very often cardboard boxes are used for the storage and transport of very heavy products or other objects. In such situations, the manufacturer of the heavy product may order cardboard boxes with specially formed handles on each side of the box for the purposes of grasping and lifting the box. The handles are formed by making C-shaped cuts in the side of the box. The cardboard lying inside the "C" can be pushed inwards and folded along a line between each end of the cut, thus forming a hole. Most often, the fold line is at the top of the hole, allowing the user to grip the handle more comfortably as the smooth outer surface of the cardboard is resting on their hands and not the sharper edges of cut cardboard.

There are many situations where the initial user of a cardboard box (e.g. the manufacturer of a product) does not wish to incur the expense of having handles cut in the box. As a result, the box is much more difficult to carry when the boxes are individually transported. If the box is reused later, for moving, storage etc., the lack of a handle in the cardboard will make carrying the box more difficult. Movers, for example, are often faced with the unpleasant prospect of transporting dozens of cardboard boxes, few of which have handles.

U.S. Pat. No. 5,806,190 (issued to the inventor of the present invention) discloses a handle cutter assembly (the '190 cutter) with a main body, a detachable blade with a C-shaped cutting profile extending from the main body and a guide body which pierces the cardboard box from the other side so as to guide the main body and blade to the desired location. This handle cutter assembly also uses a unique blade with high and low portions. The high portions are used to pierce the cardboard, while the lower portions follow through to produce the desired cut. While the '190 cutter is a very useful tool, improvements could be made. The blade of the '190 cutter is always exposed and poses potential risks to users when it is not in use.

Accordingly, there is a need for an improved handle cutter assembly which can be produced inexpensively, can use replaceable blades and which can help prevent cutting when the handle cutter assembly is not in use.

SUMMARY OF THE INVENTION

In accordance with one aspect of the present invention, there is provided a handle cutter assembly.

The handle cutter assembly has a body having an outer shell defining a blade cavity therein. The body has an upper end and a lower end. A lower aperture is positioned in the lower end. The body also has a blade slider mounted thereto and a grip portion mounted to its upper end.

A cutting blade is mounted within the blade cavity. The cutting blade is slidable by the blade slider between a retracted position substantially within the blade cavity and a cutting position. In the cutting position, the cutting blade extends below the lower end through the lower aperture. The cutting blade has a cutting edge extending away from the body which has a C-shaped cutting profile.

In keeping with the present invention, the blade slider may be integral with the grip portion. Further, the grip portion may be slidably mounted to the body.

In addition, the grip portion may also have a lower aperture adapted to receive the upper end of the body.

In the handle cutting assembly, the cutting blade may also be biased to one of the retracted position and the cutting position.

Further, a biasing member may be mounted to one of the blade slider and the cutting blade.

In a further variation, the biasing member may be a spring mounted between a stop section of the body and the grip portion. Such a configuration may also include a blade connector affixed to the grip portion with the spring being mounted proximate to, or even around, the blade connector so as to bias the cutting blade.

The handle cutter assembly may also have a base member with at least one protruding guide member. The body may have at least one guide chamber adapted for matingly receiving the protruding guide member.

In a further variation, the base assembly may have a pair of guide members and the body may have a pair of guide chambers.

Optionally, the base member also has a lower plate member and a wall member extending upwardly from the perimeter of the lower plate member. Further, the wall member and the lower plate member may define a base blade cavity therein, the base blade cavity being adapted to receive the cutting blade in the cutting position.

In a still further variation, the handle cutter may have a lock for releasably maintaining the blade in one of the retracted position and the cutting position. Still further, the assembly may also have a lock for releasably maintaining the at least one guide member within one of the guide chambers.

The cutting blade may have at least one portion having a variable height. Further, the cutting edge may have a plurality of lower portions and upper portions.

The cutting edge may be adapted to form a C-shaped cut between a start point and an end point. The cut is sized such that handles can be formed when the cutting edge is applied to a solid material by folding the portion of the material lying substantially within the C-shaped cut away from the portion of the material not lying within the C-shaped cut.

Still further, the cutting blade may be detachably mounted within the blade cavity.

The cutting blade may further include a cutting blade mounting plate affixed to an upper portion of the cutting blade. In such a configuration, the cutting blade mounting plate is detachably affixed to the blade slider.

A portion of the body, the grip portion or the cutting blade may also be adapted to receive a logo thereon.

The handle cutter assembly may further include a laterally extending side blade slidably mounted to either the body and the grip portion. The side blade is slidable between a retracted side blade position, lying substantially within one of the body and the grip portion, and an extended side blade position.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION

Figure 1:
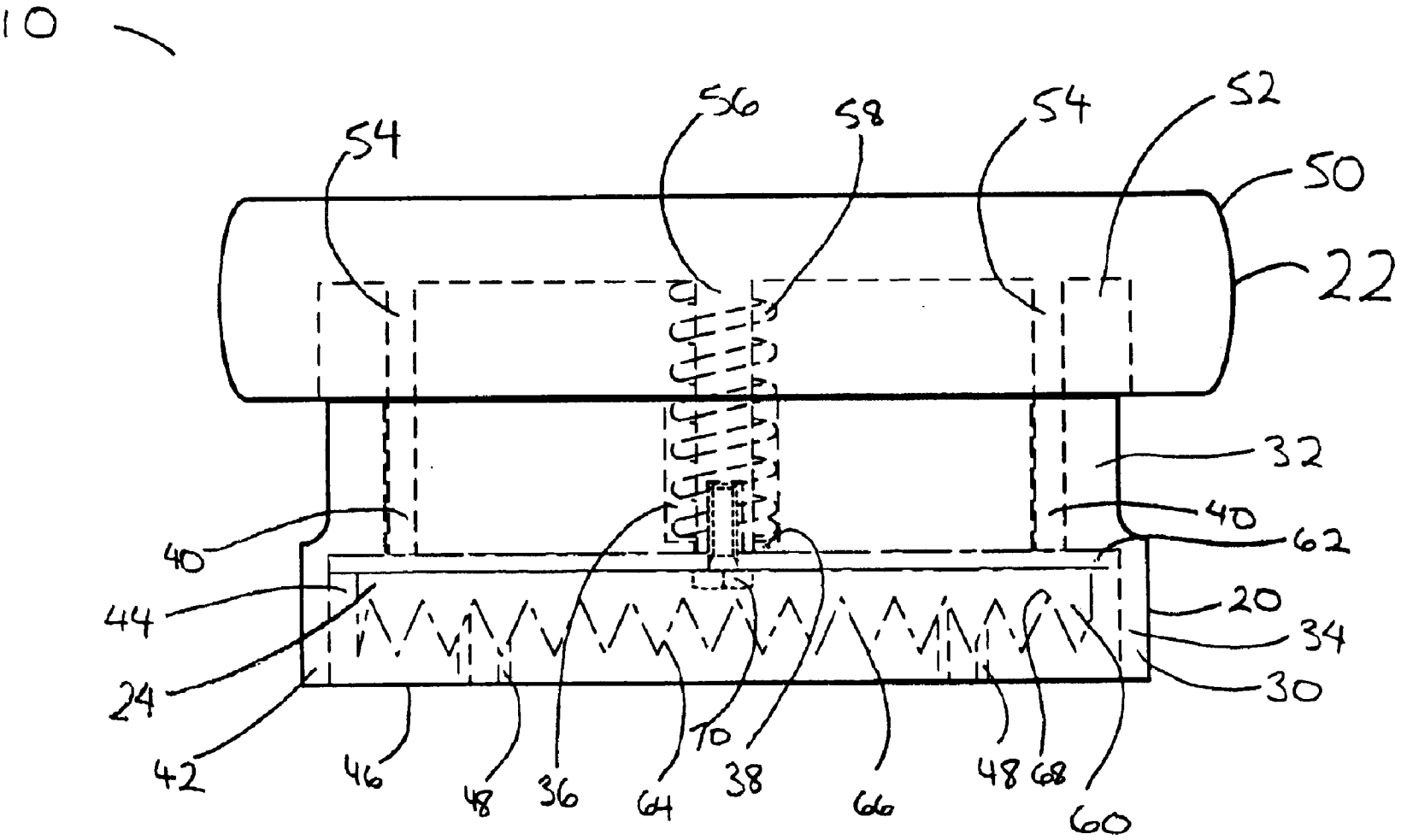
FIG. 1 is a front plan view of a handle cutter assembly in the retracted position in accordance with the present invention.

The novel features which are believed to be characteristic of the present invention, as to its structure, organization, use and method of operation, together with further objectives and advantages thereof, will be better understood from the following discussion.

FIGS. 1 through 8 show a handle cutter assembly 10 in accordance with present invention. Handle cutter assembly 10 is made up of a body 20, a grip portion 22 slidably mounted to body 20, a blade assembly 24 affixed to grip portion 22 and a base guide 26.

Figure 5:
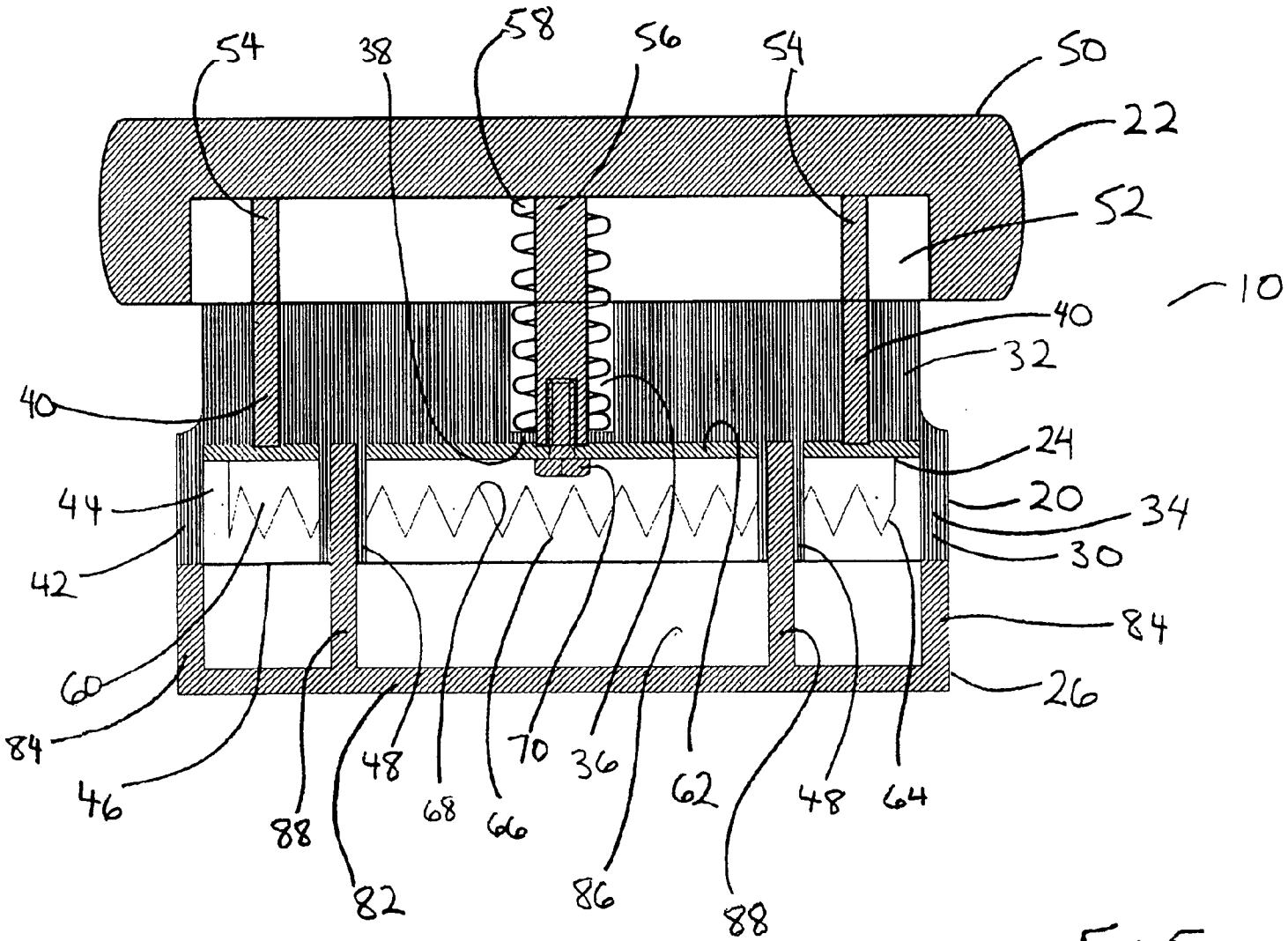
FIG. 5 is a sectional front plan view of the handle cutter assembly including the base guide in the cutting position taken along line 3—3 of FIG. 3.

Body 20 is cylindrical body having a variable cross-section. Body 20 has an outer shell 30 surrounding an upper end or portion 32 and a lower end or portion 34. Upper portion 32 preferably has a smaller cross-sectional area than lower portion 34. Upper portion 32, as shown in FIG. 5, has a generally solid interior. However, upper portion 32 is provided with a blade connector aperture 36. Blade connector aperture 36 is a downwardly extending cylindrical aperture which us centrally located within upper portion 32. Blade connector aperture 32 extends downwardly from the upper edge of upper portion 32 to a spring stop section 38. Spring stop section 38 is a shoulder extending inwardly into blade connector aperture 36 resulting in a reduced diameter at the bottom of upper portion 32. Upper portion 32 is also provided with a pair of cylindrical apertures in the nature of blade stabilizer guides 40 which extend through the entire solid interior of upper portion 32. Blade stabilizer guides 40 are laterally spaced from—but generally parallel to—blade connector aperture 36.

Lower portion 34 is a generally hollow section of body 20 having lower side walls 42 defining a blade cavity 44 therein. Lower portion 34 terminates in a lower aperture 46 which is obround-shaped within the lower edges of lower side walls 42. A pair of guide chambers in the nature of guiding pin guides 48 extend downwardly through blade cavity 44 from the base of solid portion of upper portion 32. Guiding pin guides 48 are hollow cylindrical tubes. The pair of guiding pin guides 48 are positioned inwardly of blade stabilizer guides 40 on opposed sides of blade connector aperture 36.

Grip portion or blade slider 22 is slidably mounted to upper portion 32 of body 20. Grip portion 22 is composed of a shell 50 defining an inner body cavity 32. A pair of cylindrical blade stabilizer arms 54 extend downwardly from the inner surface of shell 50. In addition, a cylindrical body in the nature of blade connector 56 extends downwardly from the centerpoint of the inner surface of shell 50. Blade connector 56 is provided with connecting screw threads in the hollowed lower portion of blade connector 56 to permit the threaded insertion of a screw or bolt. A biasing member in the nature of return spring 58 is mounted about blade connector 56. Blade connector 56 and blade stabilizer arms 54 preferably are of the same length.

When grip portion 22 is mounted to upper portion 32, upper portion 32 is positioned within inner body cavity 52. Stabilizer arms 54 are positioned within blade stabilizer guides 40 while blade connector 56 is positioned within blade connector aperture 36. Return spring 58 lies between spring stop section 38 and the inner surface of shell 50. When return spring 58 is at its resting extension as shown in FIGS. 1 and 5 (i.e. not under compression), there is a gap between the inner surface of shell 50 and the top of upper portion 32. Blade Stabilizer arms 54 and blade connector 56 are perferably positioned withing their respective apertures but do not extend below the lower ends of their respective apertures.

Figure 2:
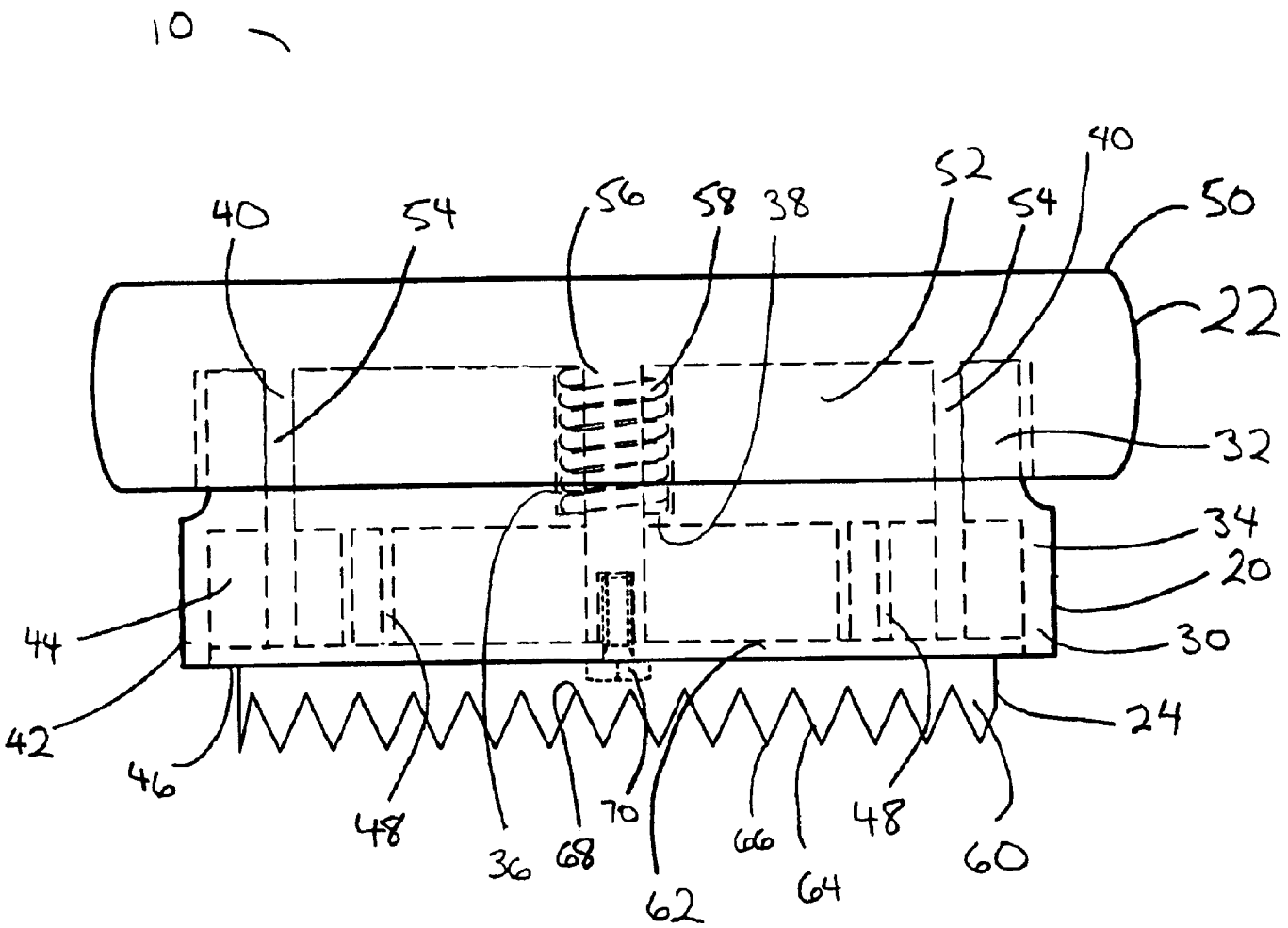
FIG. 2 is a front plan view of the handle cutter assembly of FIG. 1 with the blade assembly in the cutting position.
Figure 3:
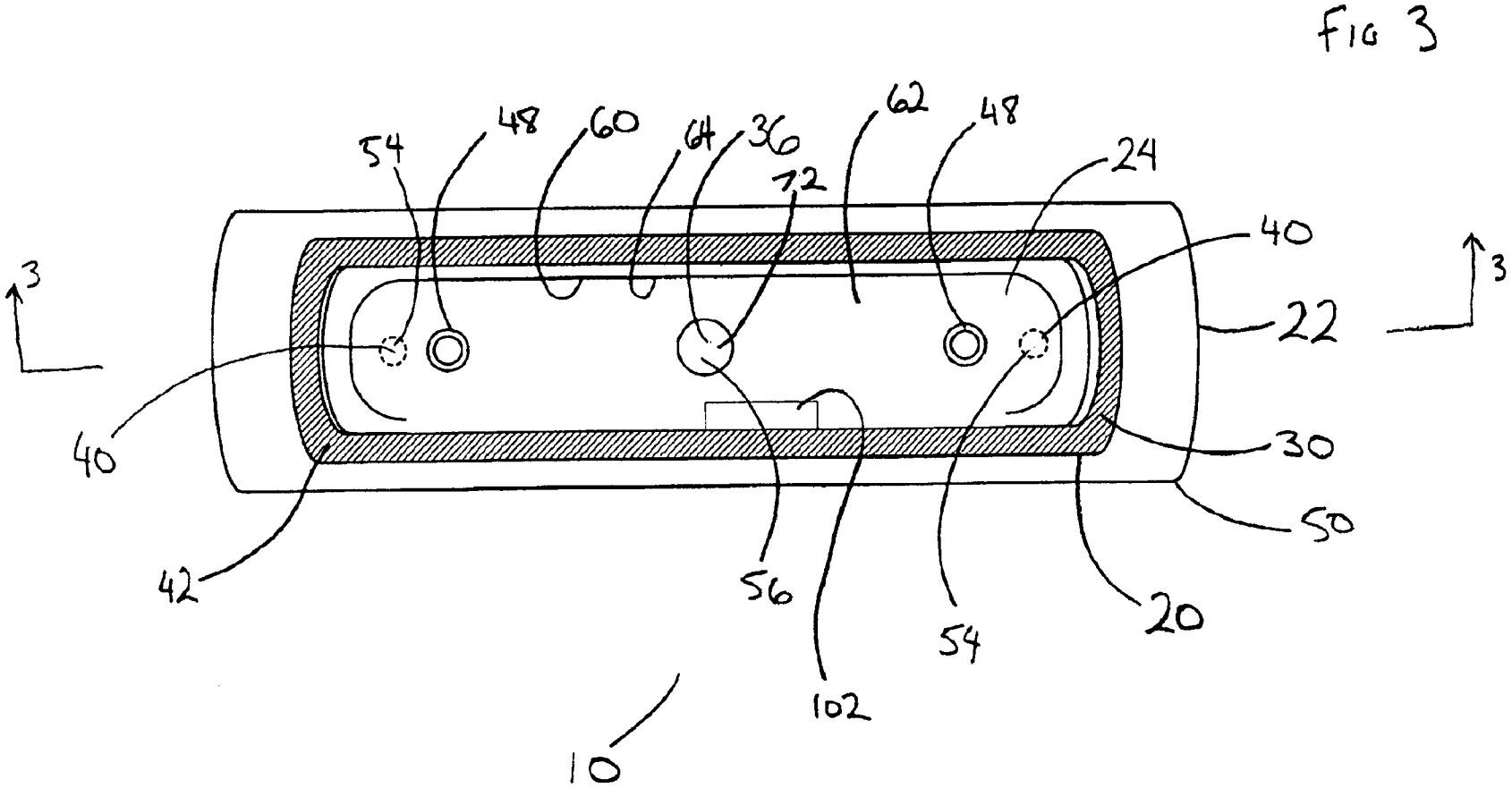
FIG. 3 is a bottom view of the handle cutter assembly of FIG. 1.
Figure 4:
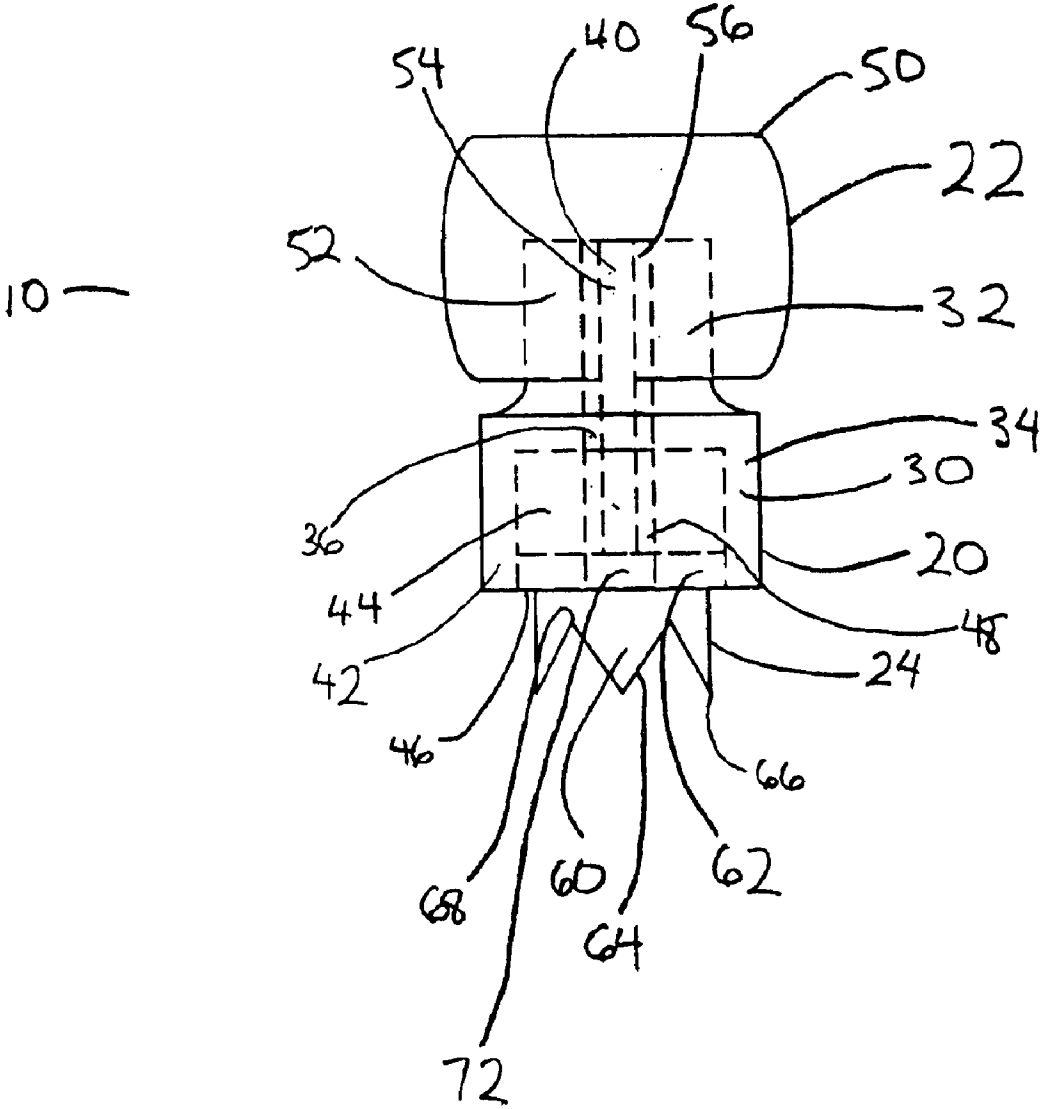
FIG. 4 is an end view of the handle cutter assembly of FIG. 2.

Blade assembly 24 is composed of a cutting blade 60 mounted to a blade mounting plate or blade base 62. As shown in FIG. 3, blade base 62 is an plate sized to fit within blade cavity 44. Cutting blade 60 extends along a C-shaped line to form a C-shaped cutting profile near the perimeter of blade base 61 and extends downwardly therefrom. Cutting blade 60 can have numerous configurations. FIG. 2 shows cutting blade 60 having a cutting edge 64 and having a variable height in a sawtooth-like configuration. Cutting edge 64 has lower and upper portions 66 and 68 respectively. Lower portions 66 are painted and are designed to perform the initial piercing of a cardboard box, while the remainder of the cutting profile is produced by upper portions 68.

As shown in FIG. 5, a fastener in the nature of connecting bolt 70 passes through a connecting bolt aperture 72 in the center of blade base 62, through the lower portion of blade connector aperture 36 and is threaded into blade connector 56. The insertion of connecting bolt 70 into blade connector 56 acts to affix blade assembly 24 to grip portion 22. Blade stabilizer arms 54 abut the upper surface of blade base 62. Blade base 62 is also provided with a pair of guide pin apertures 68 on either side of connecting bolt aperture 72.

Base guide 26 is separate from body 20. Base guide 26 is composed of a lower plate 82, and a wall member 84 extending upwardly from the perimeter of lower plate 82. Wall member 84 and lower plate 82 define a base blade cavity 86. Lower plate 82 preferably has the same area as the lateral cross-sectional area of lower portion 34 of body 20. A pair of cylindrical guide members in the nature of guide pins 88 extends upwardly from lower plate 82 and extend above wall member 84.

Figure 8:
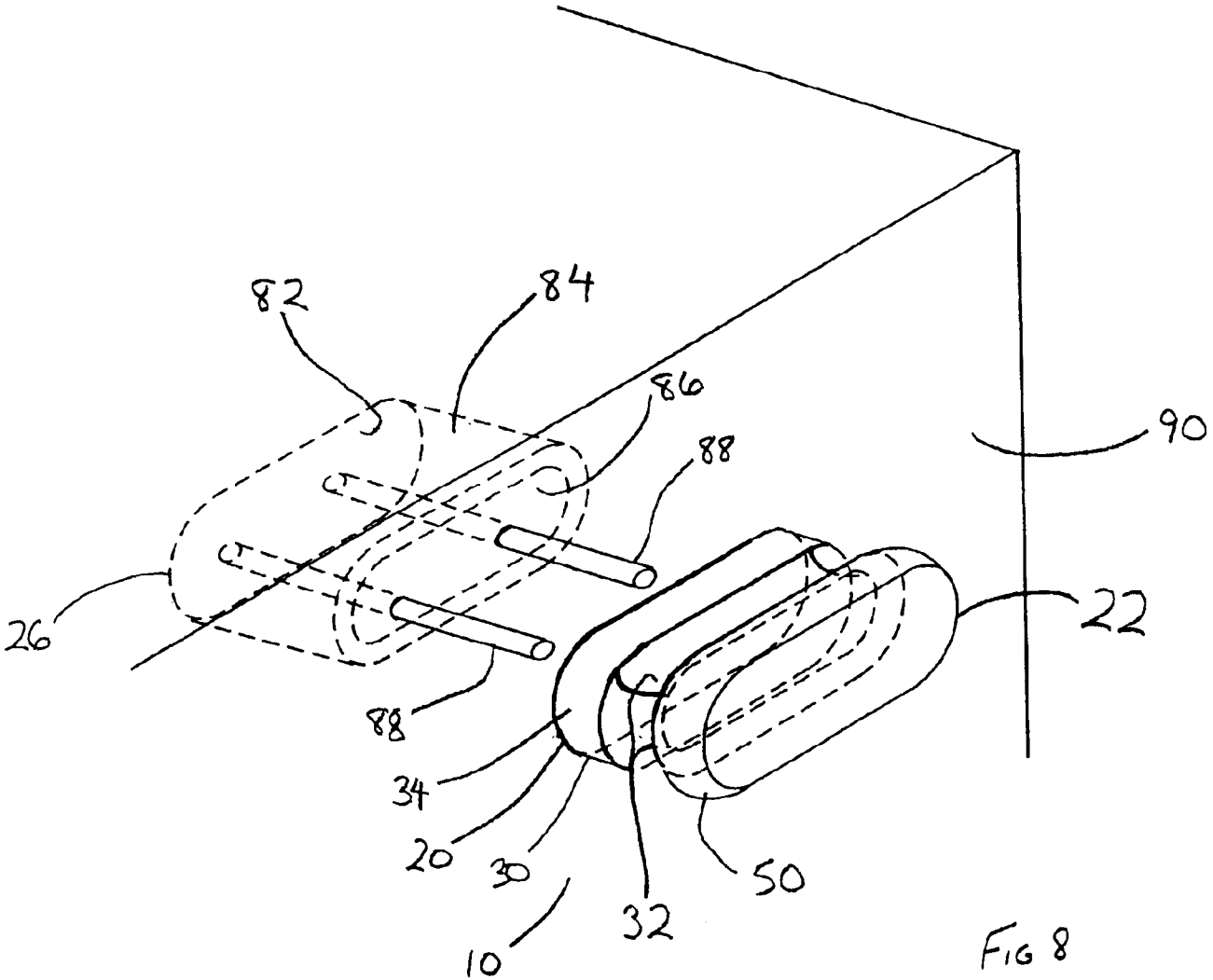
FIG. 8 is a perspective view of a handle cutter assembly in accordance with the present invention with the body aligned with the base guide prior to cutting a C-shaped handle.

In operation, as shown in FIG. 8, base guide 26 is placed on the inside of a cardboard box 90 into which C-shaped handles are to be cut. Guide pins 88 pierce the cardboard and pass through to the outside of the cardboard box. Body 20 is pushed onto guide pins 88 by inserting guide pins 88 into guiding pin guides 48 until the bottom of lower portion 34 abuts the outside surface of the cardboard box. At this stage, blade assembly 24 is in a retracted position (shown in FIG. 1) within blade cavity 44 due to the biasing action of return spring 58 pushing upwardly on shell 50 of grip portion 22.

At this point, cutting blade 60 has not yet passed below lower aperture 46 and is positioned to cut a C-shaped handle in the cardboard of the paragraph. Grip portion 22 is pushed downwardly relative to body 20. Because blade assembly 24 is affixed to grip portion 22 through the insertion of connection bolt 70 into blade connector 56, blade assembly 24 begins to slide downwardly through blade cavity 44. Blade stabilizer arms 54 push downwardly on the upper surface of blade base 62 so as to keep blade base 62 level during cutting. As the lower portions 66 of cutting edge 64 pass through lower aperture 46 they begin to pierce the outer surface of cardboard box 90. As blade assembly 24 continues to move downwards, the cardboard is being cut by higher and higher portions of cutting edge 64. As lower portions 66 of cutting edge 64 pass through the opposite surface of the cardboard material, they are received within the blade cavity 86 of base guide 26. Thus base guide 26 serves the purpose of both positioning the handle opening cut as well as receiving cutting blade 60 within blade cavity 86 so that the user does not cut themselves.

When blade assembly 24 reaches its lowermost position, dictated by the abutment of the inner surface of shell 50 of grip portion 22 with the top of upper portion 32, blade assembly 24 is in the cutting position. At this stage, the user releases some of the downward force being applied to shell 50. Return spring 58, which is in compression, acts to push shell 50 upwardly from body 20. This motion causes blade assembly 24 to retract within blade cavity 44 of body 20.

After cardboard box 90 is cut, handle cutter assembly 10 is removed. Cardboard box 90 now has a C-shaped cut on one of its sides. The portion of cardboard lying within the C-shaped cut may be pushed inwardly and folded along a line between the two endpoints of the C-shaped cut to form a handle hole. Preferably, cutting blade 60 is sized such that a person's hand can fit within the handle hole. A pair of cuts formed on opposite sides of cardboard box 90 will allow a user to carry cardboard box 90 by placing one hand in each of the handle holes.

After a number of uses, cutting edge 64 may become dull. One advantage to the embodiment described herein is that connecting bolt 70 may be removed. Blade assembly 24 may thus be replaced when cutting edge 64 is no longer sharp. It will be obvious to those skilled in the art that the fastener which connects cutting blade 60 to blade base 62 may be replaced by a wide variety of fastening mechanisms including a quick connect-disconnect style of connector to allow for easy attachment and removal cutting blade 60.

Figure 6:
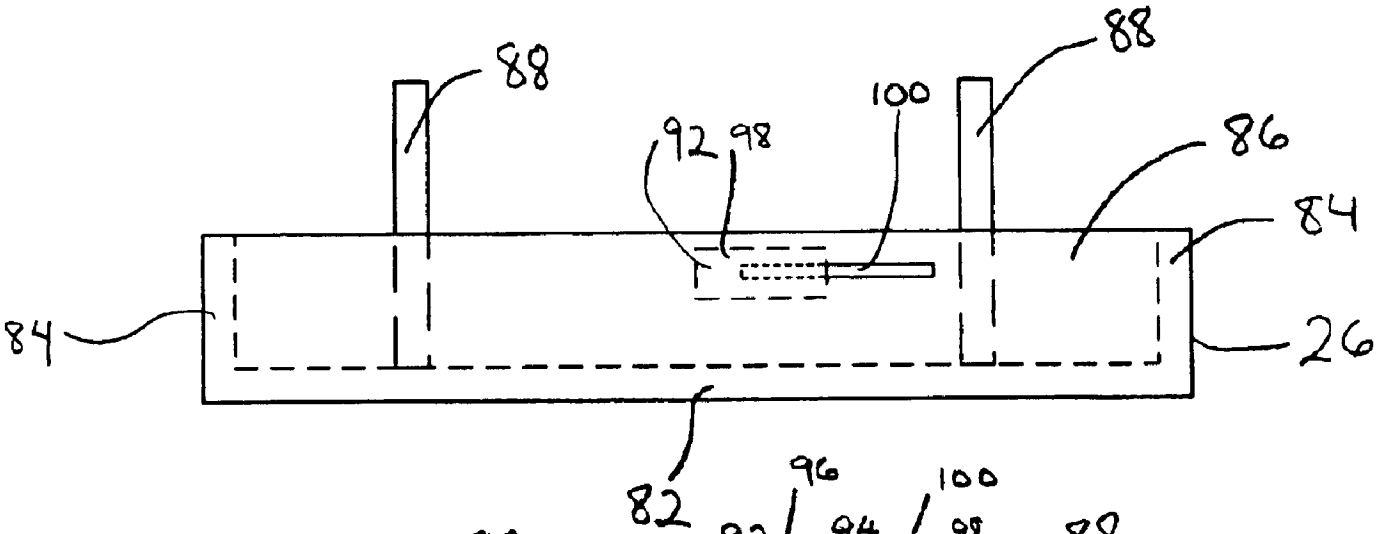
FIG. 6 is front plan view of the base guide of a handle cutter assembly in accordance with the present invention.
Figure 7:
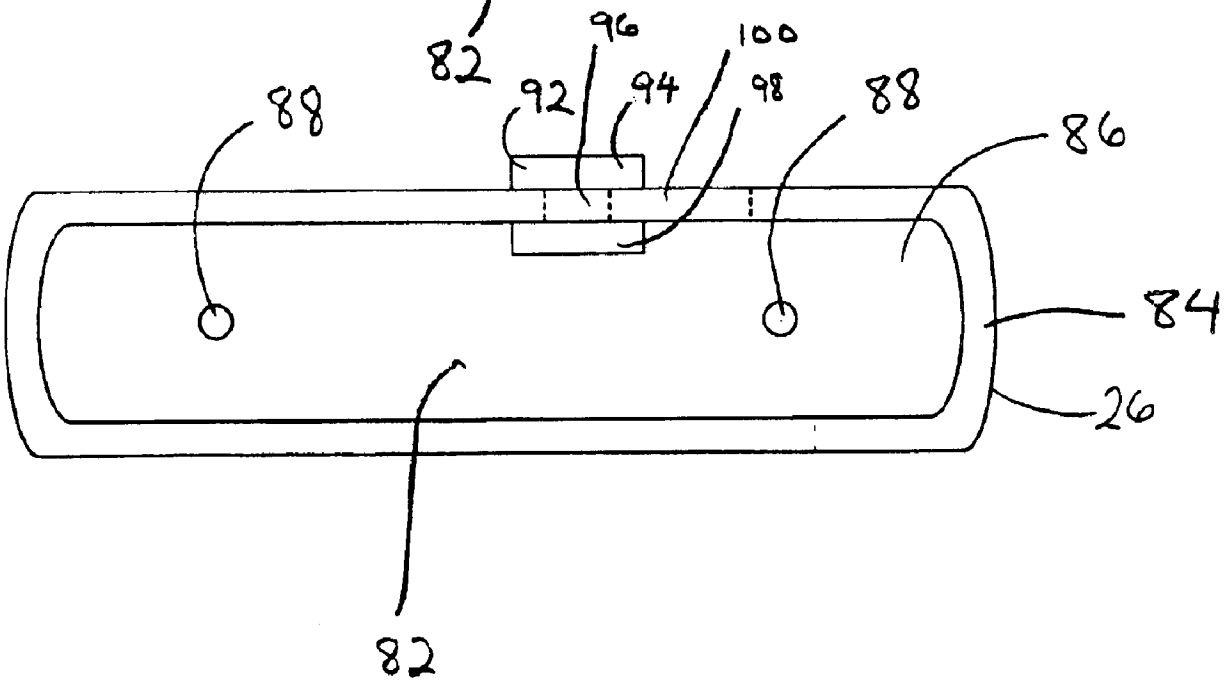
FIG. 7 is a top plan view of the base guide of FIG. 6.

Optionally, a locking mechanism may be used to attach base guide 26 to body 20. Lock 92 as shown in FIGS. 6 and 7 has a thumb-operated push block 94, a slider 96 and a locking block 98. Push block 94 is mounted outside of the upper portions of wall member 84 of base guide 26. Slider 96 is affixed to the inside of push block 94 and passes through wall member 84 in a lock slide 100. Locking block 98 is affixed to slider 96 inside base blade cavity 86. Lock 92 is slidable from an unlocked position to a locked position. Blade base 62 is provided with a notch 102 in its perimeter corresponding to the size and position of locking block 98 when lock 92 is in the unlocked position. Thus, while cutting, blade base 62 may pass into and out of inner base blade cavity 86 without encumbrance from locking block 98. To attach base guide 26 to body 20, guide pins 88 are inserted into guiding pin guides 48. Grip portion 22 is pushed downwardly until blade assembly 24 is in the cutting position. Push block 94 is pushed until lock 92 is in the locking position. When grip portion 22 is released, blade assembly 24 is prevented from returning to the retracted position by the locking block 98 which abuts the upper surface of blade base 62. The biasing action of return spring 58 acts to tightly keep base guide 26 and body 20 together for storage purposes. Another advantage of using a lock to keep blade assembly 24 in the cutting position is that the storage space required for the handle cutter assembly 10 is reduced. While an individual handle cutter assembly may not require a great deal of storage space, the reduction of space required for the transport of hundreds of assemblies may be significant. Another advantage is that handle cutter assembly 10 can be safely stored without posing a risk to users as cutting blade 64 is kept safely within base guide 26. A variety of alternatives to lock 92 will be obvious to those skilled in the art. For example, a lock may also be applied to keep blade assembly 24 in the retracted position.

In addition, further guide pins 88 and additional blade stabilizer arms 54 may be utilized. Further, outer shell 30 of body 24 or shell 50 of grip portion 22 may be provided with a portion onto which a word or logo may be molded or printed thereon are.

Optionally, a lip lay extend downwardly from the lower edge of body 20 to surround the upper portions of base guide 26 when handle cutter assembly 10 is being stored. Likewise, a lip may instead extend upwardly of the upper portions of base guide 26 to surround the lower edge of body 20. In either configuration, the lip on one of the base guide and the body may cooperate with the other of the base guide and the body to form catch-type locking mechanism.

Cutting blade 60 may also be shaped in wide variety of configurations. Cutting blade 60 may be composed of multiple blade sections for example. While a sawtooth configuration is disclosed herein, a variety of other configurations are possible. Preferably, cutting blade 60 will have lower piercing portion 66 although a cutting blade having a uniform height can also be used.

Further, a linear wall member may extend downwardly from blade bass 62 between the ends of cutting blade 60, having a straight or sharpened edge, so as to make a fold line in the cardboard to assist the user in folding the cutout portion of the cardboard inwardly. Optionally, a corresponding linear wall member may extend upwardly from base plate 82 to form a fold on the inside of the cardboard when the cut is made.

Still further, a horizontally extending knife blade may be incorporated within body 20 or grip portion 22. The knife blade may be slidable outwards with a thumb control slider assembly. The knife blade could be slidable such that it is completely surrounded by the body or grip portion to protect the use when not in use.

Other modifications and alterations may be used in the design and manufacture of the apparatus of the present invention without departing from the spirit and scope of the accompanying claims.

Throughout this specification and the claims which follow, the directions "up" and "down" are used. These directions shall be interpreted in accordance with the orientation shown in FIG. 5, unless the context requires otherwise, such that the grip portion 22 is the uppermost part of assembly 10 while base guide 26 is the lowermost part.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially vertical is intended to mean perpendicular to a horizontal orientation, or near so, and/or exhibiting characteristics associated with a general vertical element or orientation.

What is claimed is:

1. A handle cutter assembly comprising:

(a) a body having an outer shell, said outer shell defining a blade cavity therein, said body having an upper end and a lower end, said lower end having a lower aperture;

(b) a grip portion mounted to said upper end of said body;

(c) a blade slider mounted to said body; and (d) a cutting blade slidably mounted within said blade cavity, said cutting blade being slidable by said blade slider between a retracted position substantially within said blade cavity and a cutting position whereby the cutting blade extends below said lower end through said lower aperture, said cutting blade having a cutting edge extending away from said body, said cutting edge having a C-shaped cutting profile.

2. A handle-cutter assembly as claimed in claim 1, wherein said blade slider is integral with said grip portion.

3. A handle-cutter assembly as claimed in claim 2, wherein said grip portion is slidably mounted to said body.

4. A handle-cutter assembly as claimed in claim 3, wherein said grip portion has a lower aperture adapted to receive the upper end of said body.

5. A handle-cutter assembly as claimed in claim 1, wherein said cutting blade is biased to one of said retracted position and said cutting position.

6. A handle-cutter assembly as claimed in claim 5, further comprising a biasing member mounted to one of said blade slider and said cutting blade.

7. A handle-cutter assembly as claimed in claim 6, wherein said blade slider is integral with said grip portion;

wherein said biasing member is a spring;

wherein said body has a stop section; and, further comprising a blade connector extending between and affixed to said grip portion and said cutting blade, said spring being mounted between said grip portion and said stop section proximate to said blade connector such that said cutting blade is biased to said retracted position.

8. A handle-cutter assembly as claimed in claim 1, further comprising a base member, said base member having at least one protruding guide member, said body having at least one guide chamber adapted for matingly receiving said protruding guide member.

9. A handle cutter assembly as claimed in claim 8, further comprising a lock for releasably maintaining said at least one protruding guide member within said guide chamber.

10. A handle-cutter assembly as claimed in claim 1, further comprising a base member, said base member having at least two protruding guide members, said body having at least two guide chambers each of which is adapted for matingly receiving said protruding guide member.

11. A handle cutter assembly as claimed in claim 10, wherein said base member further comprises a lower plate member and a wall member extending upwardly from the perimeter of said lower plate member.

12. A handle cutter assembly as claimed in claim 11, wherein said wall member and said lower plate member define a base blade cavity therein, said base blade cavity being adapted to receive said cutting blade in said cutting position.

13. A handle cutter assembly as claimed in claim 1, further comprising a lock for releasably maintaining said blade in one of said retracted position and said cutting position.

14. A handle cutter assembly as claimed in claim 1, wherein said cutting blade has at least one portion having a variable height.

15. A handle cutter assembly as claimed in claim 14, wherein said cutting edge has a plurality of lower portions and upper portions.

16. A handle cutter assembly as claimed in claim 1, wherein said cutting edge is adapted to form a C-shaped cut between a start point and an end point, said cut being sized such that handles can be formed when said cutting edge is applied to a solid material by folding the portion of the material lying substantially within said C-shaped cut away from the portion of the material lying substantially outside of said C-shaped cut.

17. A handle cutter assembly as claimed in claim 1, wherein said cutting blade is detachably mounted within said blade cavity.

18. A handle cutter assembly as claimed in claim 17, wherein said cutting blade further comprises a cutting blade mounting plate affixed to an upper portion of said cutting blade, said cutting blade mounting plate being detachably affixed to said blade slider.

19. A handle cutter assembly as claimed in claim 1, wherein at least one of the body, the grip portion and the cutting blade is adapted to receive a logo thereon.

* * * * *